US007870750B2

(12) United States Patent
Yoon et al.

(10) Patent No.: US 7,870,750 B2
(45) Date of Patent: Jan. 18, 2011

(54) SYSTEM AND METHOD FOR CONTROLLING DEMAND OF MULTI-AIR-CONDITIONER

(75) Inventors: Young-Soo Yoon, Seoul (KR); Sang-Chul Youn, Seoul (KR); Duck-Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 452 days.

(21) Appl. No.: 11/929,767

(22) Filed: Oct. 30, 2007

(65) Prior Publication Data

US 2008/0178615 A1 Jul. 31, 2008

(30) Foreign Application Priority Data

Jan. 26, 2007 (KR) ..... 10-2007-0008570

(51) Int. Cl.
*F25B 7/00* (2006.01)

(52) U.S. Cl. ..... 62/175; 62/179

(58) Field of Classification Search ..... 62/79, 62/179, 175, 159, 199, 200; 700/276, 279, 700/277; 454/229
See application file for complete search history.

(56) References Cited

U.S. PATENT DOCUMENTS 4,809,154 A * 2/1989 Newton ..... 700/28
5,207,070 A * 5/1993 Miyazaki ..... 62/160
5,265,436 A * 11/1993 Murata et al. ..... 62/175
5,279,458 A * 1/1994 DeWolf et al. ..... 236/47
5,323,617 A * 6/1994 Ichikawa ..... 62/129
5,383,336 A * 1/1995 Nishida et al. ..... 62/115
5,522,230 A * 6/1996 Shima et al. ..... 62/127
5,647,223 A * 7/1997 Wada et al. ..... 62/175
5,853,123 A * 12/1998 Okano et al. ..... 236/51
6,044,652 A * 4/2000 Nishihara et al. ..... 62/175
7,082,353 B2 * 7/2006 Kwon et al. ..... 700/277
7,340,909 B2 * 3/2008 Kwon et al. ..... 62/175
7,523,619 B2 * 4/2009 Kojima et al. ..... 62/132
2002/0029096 A1 * 3/2002 Takai et al. ..... 700/276
2003/0014985 A1 * 1/2003 Dresens et al. ..... 62/149
2004/0117069 A1 * 6/2004 Yoon et al. ..... 700/276
2004/0133314 A1 * 7/2004 Ehlers et al. ..... 700/276
2005/0204758 A1 * 9/2005 Kwon et al. ..... 62/175
2006/0219799 A1 * 10/2006 Schultz et al. ..... 236/1 C
2006/0287774 A1 * 12/2006 Yoon et al. ..... 700/276

FOREIGN PATENT DOCUMENTS

JP 06036131 A * 2/1994
JP 2006-029693 A 2/2006

* cited by examiner

*Primary Examiner*—George Nguyen
(74) *Attorney, Agent, or Firm*—Birch, Stewart, Kolasch & Birch, LLP

(57) ABSTRACT

A system for controlling multiple air conditioners. The system includes a demand control unit configured to divide the multiple air conditioners into groups, to assign a priority level to each group, to calculate an estimated power amount used by the multiple air conditioners based on an amount of power consumed by the multiple air conditioners during a predetermined time period, and to forcibly control an operation of one or more air conditioners included in a respective group based on the priority level assigned to the respective group.

22 Claims, 6 Drawing Sheets

SYSTEM AND METHOD FOR CONTROLLING DEMAND OF MULTI-AIR-CONDITIONER

This application claims priority to Korean Application No. 10-2007-0008570, filed in Korea on Jan. 26, 2007, the entire contents of which is also hereby incorporated in its entirety.

BACKGROUND OF THE INVENTION

1. Field of the Invention

The present invention relates to a system and method for controlling multiple air conditioners.

2. Description of the Related Art

An air conditioner system that is placed in a large office building generally includes multiple air conditioners placed throughout the building. The air conditioners are controlled to operate within a predetermined temperature. That is, when the temperature of a room is within an allowable range, the air conditioner is turned off. When the temperature of the room is not within an allowable range, the corresponding air conditioner is turned on. However, the related art control system does not take into account an individual's comfort.

Therefore, the related art air conditioner control system merely controls the multiple air conditioners in a constrained or limited manner without considering the comfort of individuals within the building.

SUMMARY OF THE INVENTION

Accordingly, one object of the present invention is to address the above-noted and other objects.

Another object of the present invention is to provide a system and corresponding method for controlling multiple air conditioners that takes into consideration an individual's comfort.

Another object of the present invention is to provide a system and corresponding method for controlling multiple air conditioners that divides the multiple air conditioners into groups and assigns a priority level to each group and then controlling the multiple air conditioners based on the assigned priority levels.

Yet another object of the present invention is to provide a system and corresponding method for controlling multiple air conditioners based on a recorded operating history of the multiple air conditioners.

Still another object of the present invention is to provide a system and corresponding method for controlling multiple air conditioners based on a temperature of rooms controlled by the multiple air conditioners and priorities assigned to the multiple air conditioners.

To achieve these and other advantages and in accordance with the purpose of the present invention, as embodied and broadly described herein, the present invention provides in one aspect a system for controlling multiple air conditioners. The system includes a demand control unit configured to divide the multiple air conditioners into groups, to assign a priority level to each group, to calculate an estimated power amount used by the multiple air conditioners based on an amount of power consumed by the multiple air conditioners during a predetermined time period, and to forcibly control an operation of one or more air conditioners included in a respective group based on the priority level assigned to the respective group.

In another aspect, the present invention provides a method for controlling multiple air conditioners. The method includes dividing the multiple air conditioners into groups, assigning a priority level to each group, calculating an estimated power amount used by the multiple air conditioners based on an amount of power consumed by the multiple air conditioners during a predetermined time period, and forcibly controlling an operation of one or more air conditioners included in a respective group based on the priority level assigned to the respective group.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
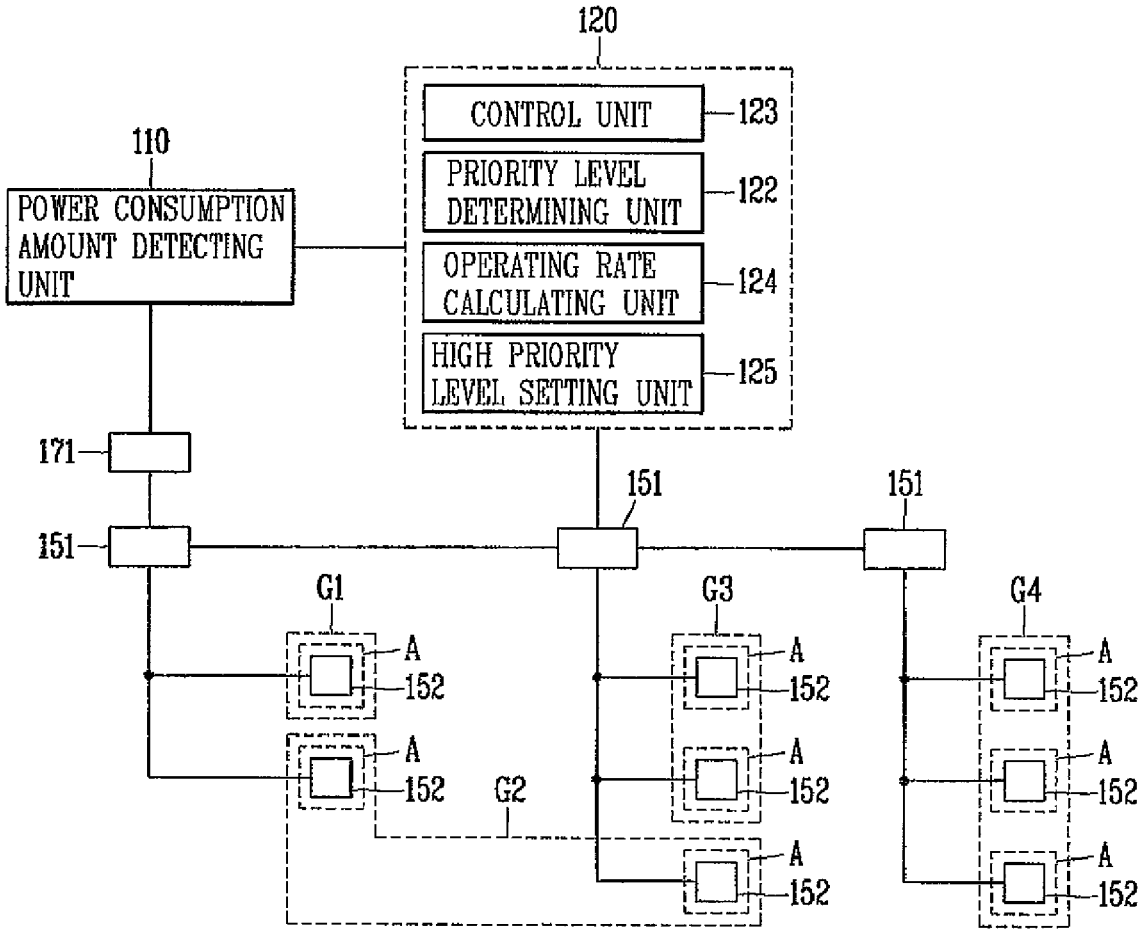
FIG. 1 is a block diagram of a system for controlling multiple air conditioners according to a first embodiment of the present invention.

A system for controlling multiple air conditioners is illustrated in FIG. 1. As shown, the system includes a power consumption amount detecting unit 110, a demand control unit 120, and multiple air conditioners having outdoor units 151 and indoor units 152. Also included is a power detecting unit (e.g., watt/hr meter) 171. The power consumption unit 110 detects an amount of power consumed by the multiple air conditioners installed in each area of a building during a certain time period.

Further, the demand control unit 120 determines an estimated power amount used by the multiple air conditioners based on the amount of consumed power detected by the power consumption amount detecting unit 110. In addition, when the estimated power amount exceeds a target power amount, the demand control unit 120 determines a priority level of the multiple air conditioners and forcibly controls an operation of the multiple air conditioners according to the priority levels.

In more detail, as shown in FIG. 1, the demand control unit 120 includes a priority level determining unit 122, a control unit 123, an operating rate calculating unit 124, and a high priority level setting unit 125. The high priority level setting unit 125 selects at least one of the multiple air conditioners to have a highest priority among the air conditioners. The highest priority air conditioner is then excluded from being forcibly controlled. In addition, the highest priority air conditioner (or air conditioners) may be selected based on how important the air conditioner is to the overall operation of the air conditioners. For example, an air conditioner included in a computer room may be set to have the highest priority, because the computers must be maintained at a particular temperature. An air conditioner or air conditioners located in a Company Director's or Company President's office may also be designated as the highest priority air conditioner to thereby exclude this air conditioner. A manager may also selectively set what air conditioner(s) is to have the highest priority.

Further, the operation rate calculating unit 124 compares the estimated power amount and a pre-set target power amount and calculates an operation rate of one or more air conditioners based on the comparison result. In addition, the operation rate calculated by the operation rate calculating unit 124 increases as the estimated power amount is greater than the target power amount. For example, the operation rate corresponds to a number of air conditioners to be forcibly controlled. Therefore, when the estimated power amount is much larger than the pre-set power amount, more air conditioners are forcibly controlled than when the estimated power amount is slightly greater than the pre-set power amount.

Further, as shown in the embodiment of FIG. 1, the priority level determining unit 122 divides the multiple air conditioners into groups G1 to G4. In more detail, the group G1 includes a single indoor unit 152, the groups G2 and G3 include two indoor units 152, and the group G4 includes three indoor units 152. The manager of the building may divide the multiple air conditioners into groups using the priority level determining unit 122 as an input device or the groups may be automatically determined by the control unit 123 based on previous operation characteristics of the air conditioners, based on temperature differences in the rooms of the building, based on pre-assigned values given to the air conditioners, etc.

In addition, the priority level determining unit 122 may sequentially set a priority level of the groups according to a user input or automatically, and when one of the groups includes more than one air conditioner, the priority level determining unit 122 may set the air conditioners in the same group to have a same priority level. For example, the groups may be sequentially assigned a priority level such that the first group is assigned a highest priority level, the second group is assigned the next highest priority level, etc. Alternatively, the priority level determining unit 122 may also set air conditioners in a same group to have different priority levels. For example, with regard to the group G4 shown in FIG. 1, the priority level determining unit 122 may set each of the indoor units 152 to have a same priority level, or may set one of the indoor units 152 that is in an important location within the building (e.g., in a computer room) to have a higher priority than the other air conditioners 152 in the group G4. The priority level determining unit 122 also excludes the air conditioner(s) set by the high priority level setting unit 125 from being forcibly controlled.

Therefore, according to an embodiment of the present invention, when the estimated power amount exceeds the pre-set power amount, an air conditioner that belongs to a group with a lower priority level is forcibly controlled before an air conditioner that belongs to a group with a higher priority level. In addition, in one example, the air conditioners that belong to the same group are forcibly controlled in sequential manner. Alternatively, and as discussed above, the air conditioners is a same group may be set to have different priority levels. Thus, in this alternative embodiment, air conditioners in a group that has a lowest priority are first forcibly controlled before air conditioners in other groups, and an air conditioner with a lowest priority level in the group having the lowest priority is forcibly controlled before other air conditioners in the lowest priority group. That is, the groups are set to have priority levels and the air conditioners in a group are also set to have priority levels (rather than lust sequentially controlling the air conditioners within a same group).

Further, and as discussed above, an area or room of a building that needs to be always cooled or heated may be set to have the highest priority level, while an area or room of the building that is not as important may be set to have a relatively low priority level. Thus, the multiple air conditioners can be forcibly controlled to improve the overall operation of the multiple air conditioners and to improve the individuals' comfort. For example, a group of air conditioners in a location of the building that includes many workers or employees may be set to have a higher priority level than, for example, a storage room, so the individual's comfort is taking into consideration.

A method of controlling multiple air conditioners according to the first embodiment of the present invention will now be described in more detail with reference to FIG. 2. FIG. 1 will also be referred to in this description.

As discussed above, the multiple air conditioners are divided into groups G1, G2, G3 and G4, in which each group includes one or more indoor units 152. Further, each group is assigned a priority level. In addition, the groups may be divided and assigned priority levels by a manager of the building, automatically based on operating histories of the air conditioners, etc. The groups G1, G2, G3 and G4 may also be sequentially assigned a priority level (i.e., the group G1 is assigned a highest priority level, the group G2 is assigned the next highest priority level, etc.). That is, in accordance with embodiments of the present invention, the groups may be divided and assigned priority levels in a variety of different methods, which allows for the individual's comfort to be taken into consideration. Therefore, the priority levels can be selectively assigned based on an importance of a particular group.

Further, the power consumption detecting unit 110 receives data regarding the power amount measured during a certain time period from the watt-hour meter 171, and transfers the received data to the demand control unit 120. Then, as shown in FIG. 2, the demand control unit 120 estimates an amount of power consumed by the air conditioners using the data received from the power consumption amount detecting unit 110 and monitors whether the estimated power amount exceeds a pre-set target power amount (S1).

When the estimated power amount exceeds the target power amount (Yes in S1), the operation rate calculating unit 124 calculates an operation rate of one or more air conditioners, and the control unit 123 determines the previously set priority level of each group (S2). Further, the control unit 123 selects a group to be forcibly controlled according to the determined priority level (S3). That is, the control unit 123 first selects a group that has the lowermost priority level to be forcibly controlled. Note that a group that has been set as the highest priority group by the high priority level setting unit 125 is excluded the forcibly controlling operation.

Figure 2:
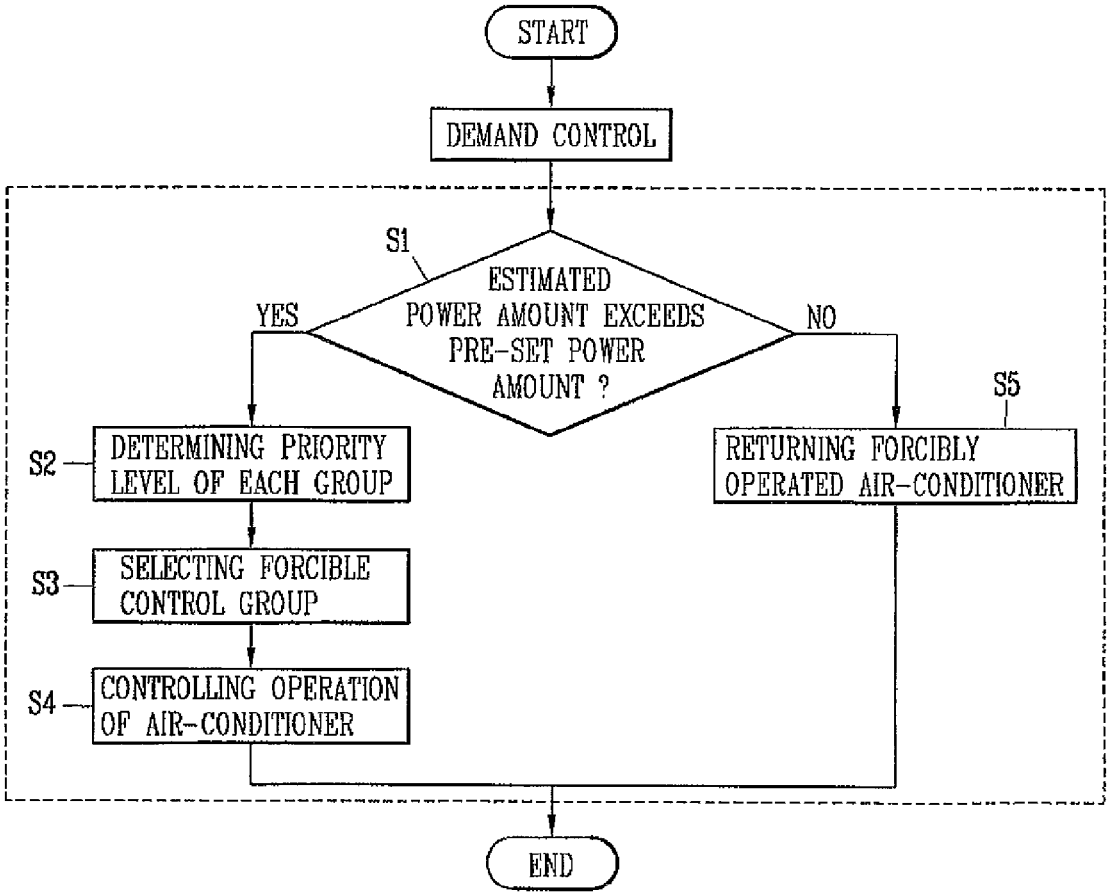
FIG. 2 is a flowchart illustrating a method for controlling multiple air conditioners according to the first embodiment of the present invention.

In addition, as shown in FIG. 2, the controller 123 forcibly controls an operation of a corresponding air conditioner belonging to a group selected in the previous stage (S4). Further, as discussed above, when more than one air conditioner belongs to the same group, the operations of the multiple air conditioners may be sequentially controlled. Alternatively, the air conditioners within a same group may have been assigned different priority levels, and in this instance, the air conditioners in the same group are forcibly controlled based on their assigned priorities (i.e., an air conditioner having the lowest priority is first forcibly controlled).

In addition, the control unit 123 controls the multiple air conditioners based on the divided groups and assigned priority levels to reduce the power consumption amount to be below the pre-set target amount. That is, the control unit 123 turns off the corresponding indoor units 152 of the air conditioners to stop air conditioning in the area. The control unit 123 may also turn off an outdoor unit 151 connected with the indoor units 152 of a corresponding air conditioner included in the selected group to thereby change an operation mode of the air conditioner to an air blow mode. Thus, the control unit 123 controls the appropriate outdoor units 151 and indoor units 153 to reduce the power consumption amount.

Further, rather than simply turning off the indoor units 152 or the outdoor units 151, the control unit 123 may control the air conditioners in a selected group to change into a different operation mode, in which the power consumption is reduced. For example, the operation mode of an air conditioner may be changed into a dehumidifying mode, the air flow strength may be changed, and/or a circulation rate of a refrigerant may be changed. In addition, as shown in FIG. 2, when the estimated power amount is smaller than the target power amount (no in S1), the demand control unit 120 returns the forcibly controlled outdoor units 151 or the indoor units 152 to their original operation state (S5).

An example of controlling multiple air conditioners according to the present invention will now be described. In this example, it is assumed there are ten indoor units in a building and that the amount of consumed power exceeds the pre-set amount by 20%. Thus, in this example, the operation rate calculating unit 124 determines the consumed power should be reduced by 20% and determines the number of air conditioners to be forcibly controlled (e.g., turned off) is two air conditioners (i.e., 20% of the ten air conditioners operating in the building). The demand control unit 120 then controls the air conditioners in a lowest priority group. If the lowest priority group only includes one air conditioner, the demand control unit 120 then controls one air conditioner in the second group such that two air conditioners are controlled (e.g., turned off) to reduce the total consumed power to be less than the pre-set target power.

Further, rather than selecting two air conditioners, the operating rate calculating unit 124 may determined to change an operation mode of one or more air conditioners to reduce the total amount of power consumed by the multiple air conditioners to be less than the pre-set target amount. For example, an operation mode of four of the ten air conditioners may be changed into an air blowing mode only (by turning off the corresponding outdoor units) to reduce the overall power consumption amount by 20%.

Therefore, when the multiple air conditioners are controlled to reduce the overall power consumption amount, the temperature of each area or room in the building is smoothly changed and not sharply changed. Thus, a user located near such an air conditioner, which is forcibly controlled, feels more comfortable. In addition, when the air conditioner is returned from the forcibly controlled state, the time taken for the air conditioner to return the room to the temperature before being forcibly controlled is reduced to thereby further increase the energy efficiency of the air conditioner.

As described above, in the system and method for controlling the multiple air conditioners according to the first embodiment of the present invention, the multiple air conditioners installed in each area in the building are divided into a plurality of groups, and each group is set with a priority level. Each air conditioner in the group may be set to have the same priority or different priorities. Further, the multiple air conditioners are controlled according to the set priority, so that the users are more comfortable.

Figure 3:
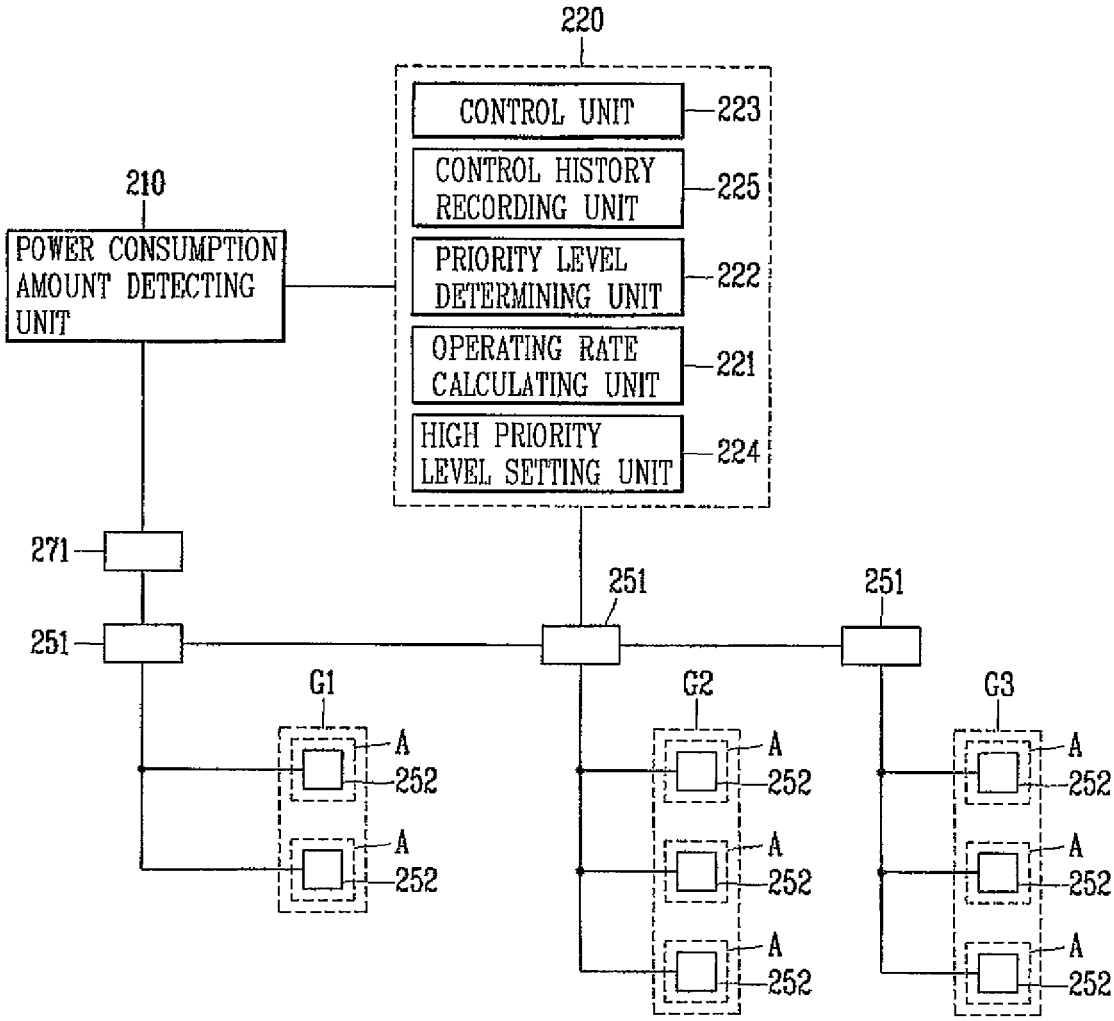
FIG. 3 is a block diagram of a system for controlling multiple air conditioners according to a second embodiment of the present invention.

FIG. 3 illustrates a system for controlling multiple air conditioners according to the second embodiment. As shown in FIG. 3, the system includes a power consumption amount detecting unit 210, a demand control unit 220 and multiple air conditioners including outdoor units 251 and indoor units 252. Also shown is a power detecting unit (watt-hour meter) 271. Note that FIG. 3 is similar to FIG. 1, except that the demand control unit 220 includes a control history recording unit 225 in addition to a control unit 223, a priority level determining unit 222, an operating rate calculating unit 221, and a high priority level setting unit 224.

In more detail, the power consumption detecting unit 210 detects a power consumption amount of the multiple air conditioners installed in each area of a building using data supplied from the watt-hour meter 271 connected with the multiple air conditioners, and transfers the data to the demand control unit 220. The demand control unit 220 then detects whether the estimated power amount exceeds a pre-set demand power amount, and when the estimate power amount exceeds the target power amount, the demand control unit 220 controls the operation of the outdoor units 251 and the indoor units 252 of the multiple air conditioners.

Similar to the first embodiment, the high priority level setting unit 224 sets an air conditioner (or air conditioners) with a highest priority level such that the air conditioner (or air conditioners) are excluded from the forcibly controlling operation. In addition, the operation rate calculating unit 221 compares the estimated power amount and the pre-set target power amount and calculates an operation rate of one or more air conditioners based on the comparison result. Further, the priority level determining unit 222 divides the multiple air conditioners into multiple groups G1 to G3, each group including one or more air conditioners, and sets a priority level of each group.

In addition, in this second embodiment, the demand control unit 220 also includes the control history recording unit 225 that records an operation history of the air conditioners controlled by the control unit 223. Therefore, the control unit 223 forcibly controls an operation of the outdoor units 251 or the indoor units 252 of the multiple air conditioners according to each set priority level as well as the recorded operation history of the multiple air conditioners.

That is, the priority level determining unit 222 considers a control history of the air conditioners recorded in the operation history recording unit 225 when setting priority levels for the groups of air conditioners (and in an alternative embodiment, for air conditioners in a same group). For example, a control history of forcibly controlled air conditioners is recorded in the operation history recording unit 225, and the priority level determining unit 222 excludes an air conditioner which has been forcibly controlled most recently or an air conditioner which has been forcible controlled a large number of times in a predetermined time period, to thus prevent a lopsided controlling of a particular air conditioner and provide a balanced forcible control method.

The method of controlling the multiple air conditioners according to the second embodiment of the present invention will now be described in more detail with reference to FIG. 4. FIG. 3 will also be referred to in this description.

In this embodiment, the multiple air conditioners are divided into three groups G1, G2 and G3, each group including one or more indoor units 252. In addition, each group is assigned a priority level using the priority level determining unit 222. As discussed in the first embodiment, the manager of the building may divide the air conditioners into groups and may set each group to have a particular priority level based on an importance of the air conditioners in the group, etc. The groups may also be divided automatically based on a recorded history or other variables (e.g., based on a temperature of each room, etc.). For example, the air conditioners may be automatically divided into a first group to include air conditioners that have been forcibly controlled more than a first number of times in a predetermined period. A second group may be formed to include air conditioners that have been forcibly controlled more than a second number of times in the predetermined period (the second number being less than the first number). Then, the first group of air conditioners is assigned a higher priority than the second group such that the air conditioners that have been forcibly controlled more often are forcibly controlled after a group of air conditioners that have been forcibly controlled a less number of times.

Figure 4:
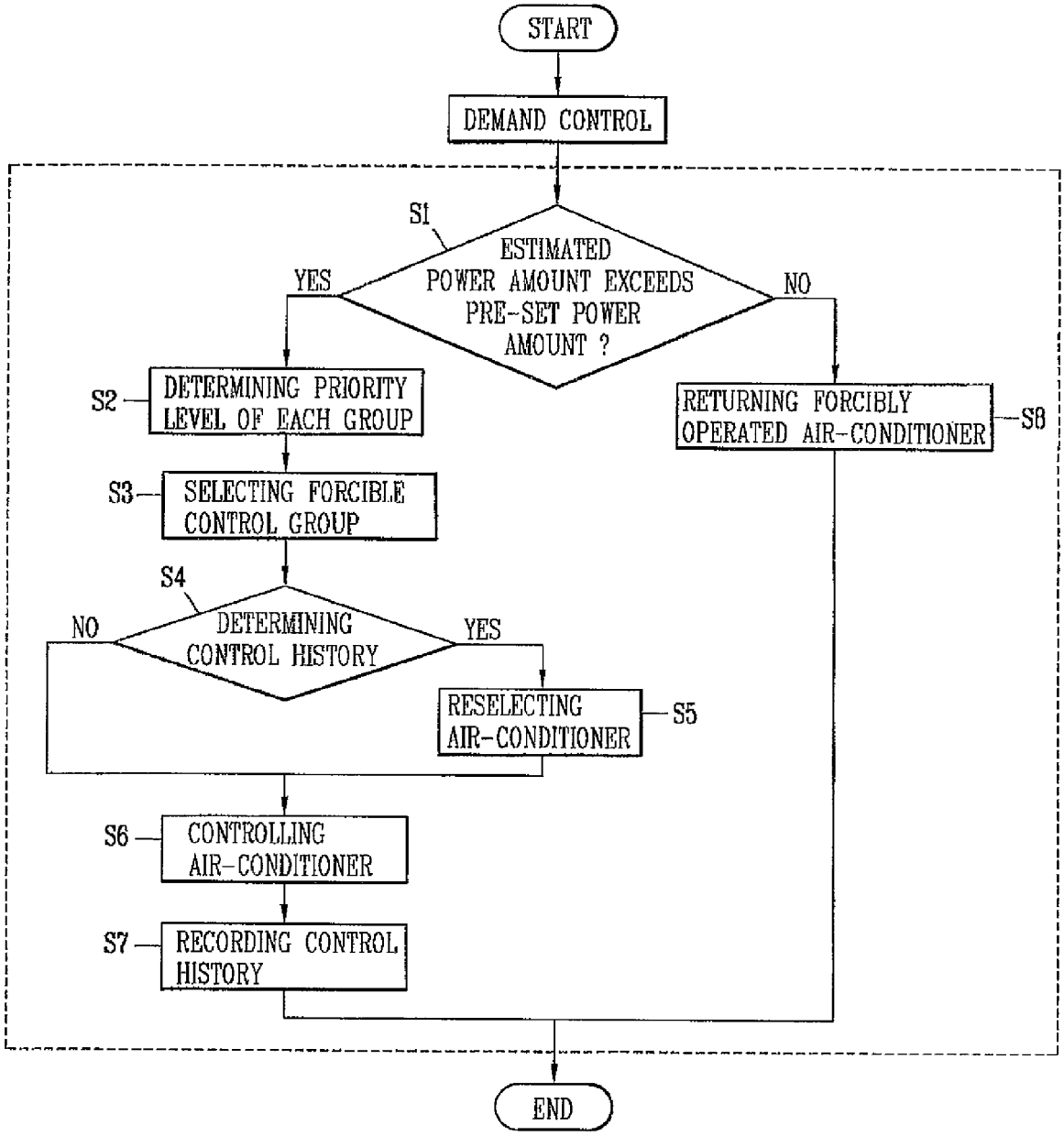
FIG. 4 is a flowchart illustrating a method for controlling multiple air conditioners according to the second embodiment of the present invention.

Similar to the first embodiment, and as shown in FIG. 4, the demand control unit 220 calculates an estimated power amount based on the detected power consumption amount, and monitors whether the estimated power amount exceeds the pre-set target power amount (S1). In addition, when the estimated power amount exceeds the target power amount (Yes in S1), the operation rate calculating unit 221 calculates an operation rate for the air conditioners (e.g., a number of air conditioners to control) and determines the set priority level of each group (S2).

Then, the control unit 223 selects a group to be forcibly controlled according to the determined priority level of each group (S3). Similar to the first embodiment, the groups are selected such that a group with the lowermost priority level is first selected. Further, any group that has been set as being the highest priority is excluded form the forcibly controlling operation. However, this operation may be omitted in which each group would be forcibly controlled (i.e., no group would be excluded). The same is true for the first embodiment (i.e., no group would be excluded). It is also possible to have two or more groups excluded by assigning each group the highest priority level.

Also, in the second embodiment, the control unit 223 determines a control history of an air conditioner from the selected group (S4). If the selected air conditioner has been already forcibly controlled (Yes in S4), the control unit 223 releases the selection of the air conditioner and selects a different air conditioner of the corresponding group (S5). If the selected air conditioner has not been forcibly controlled (No in S4), the control unit 223 maintains the selection of the air conditioner. Further, the air conditioners in the same group can be sequentially controlled or can be controlled based on priorities assigned to each air conditioner in the same group.

The control unit 223 then controls the operation of the multiple air conditioners of the selected group according to the operation rate calculated by the operation rate calculating unit 221 (namely, the control unit 223 determines the number of air conditioners to be forcibly operated within the group based on the calculated operation rate) (S6), and records the control history of the forcibly controlled air conditioners (S7). Then, when all of the selected air conditioners within the group have been forcibly controlled, the air conditioners in the group with the next priority level are controlled. Therefore, the multiple air conditioners are forcibly controlled in a balanced manner.

In addition, the control unit 223 controls the multiple air conditioners based on the divided groups, assigned priority levels and recorded operation histories to reduce the power consumption amount to be below the pre-set target amount. That is, the control unit 223 turns off the corresponding indoor units 252 of the air conditioners to stop air conditioning in the area. The control unit 223 may also turn off an outdoor unit 251 connected with the indoor units 252 of a corresponding air conditioner included in the selected group to thereby change an operation mode of the air conditioner to an air blow mode. Thus, the control unit 223 controls the appropriate outdoor units 251 and indoor units 253 to reduce the power consumption amount.

Further, rather than simply turning off the indoor units 252 or the outdoor units 251, the control unit 223 may control the air conditioners in a selected group to change into a different operation mode, in which the power consumption is reduced. For example, the operation mode of an air conditioner may be changed into a dehumidifying mode, the air flow strength may be changed, and/or to a circulation rate of a refrigerant may be changed. Meanwhile, when an estimated power amount is smaller than the target power amount, the demand control unit 220 returns the outdoor unit 251 or the indoor units 252 which have been controlled in their operation to their original operation state (S8).

As described above, in the system and method for controlling the multiple air conditioners according to the second embodiment of the present invention, the multiple air conditioners installed in each area in the building are divided into a plurality of groups, each group is set with a priority level and an operation history of the multiple air conditioners is recorded. Further, the multiple air conditioners are controlled according to the set priority which also takes into account the recorded operation histories of the multiple air conditioners, so that the users are more comfortable and the multiple air conditioners are controlled in a balanced manner.

That is, because the control history of a forcibly controlled air conditioner is recorded and a mostly recently controlled air conditioner or an air conditioner that has been forcibly controlled a large number of times during a predetermined time period is excluded from the next forcible control target, the multiple air conditioners are controlled in a balanced manner.

Figure 5:
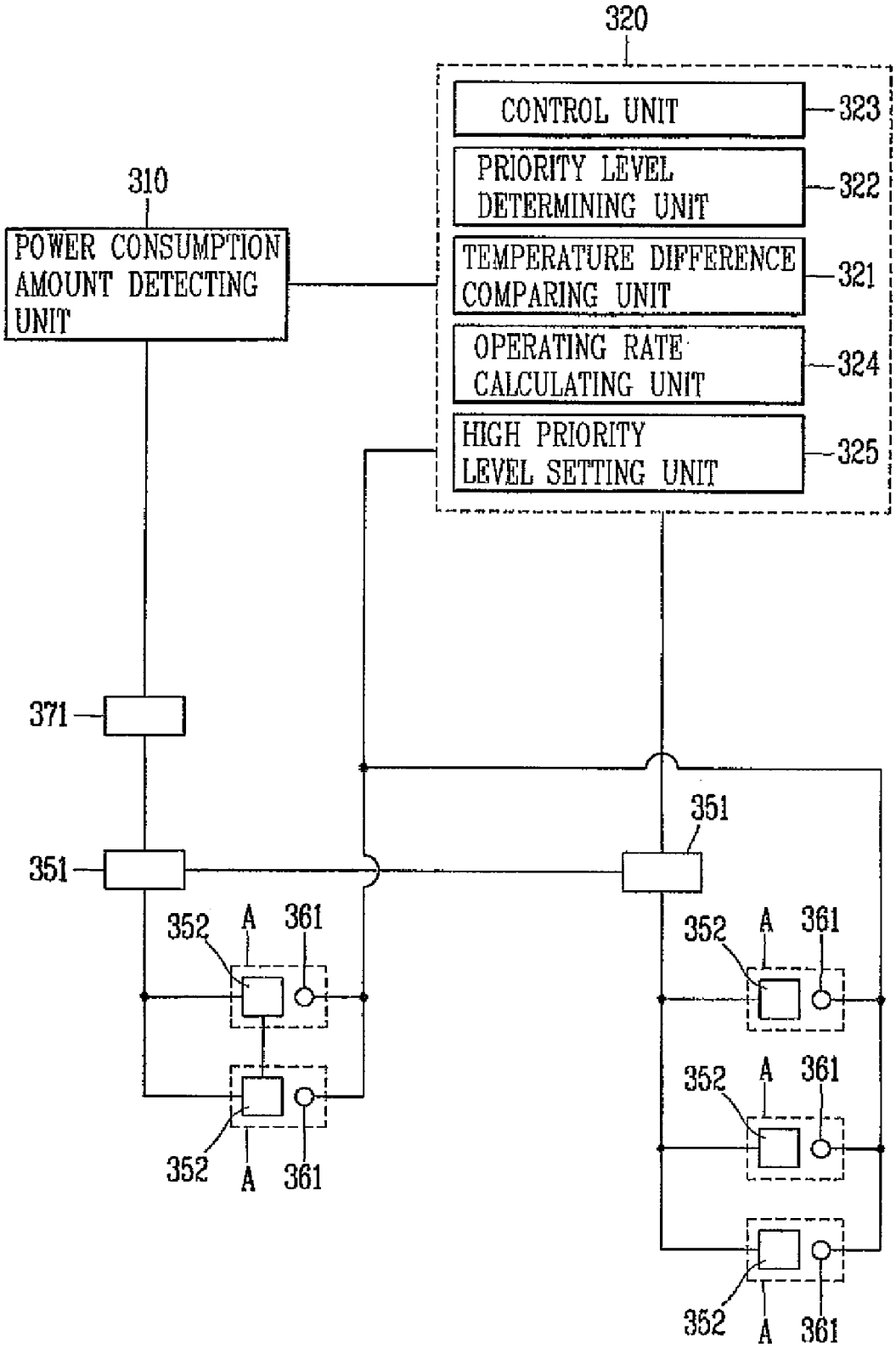
FIG. 5 is a block diagram of a system for controlling multiple air conditioners according to a third embodiment of the present invention.

A system for controlling multiple air conditioners according to the third embodiment of the present invention will now be described with reference to FIG. 5. As shown in FIG. 5, the system includes a power consumption amount detecting unit 310, a demand control unit 320 and multiple air conditioners including outdoor units 352 and indoor units 351. Also shown is a power detecting meter (watt/hr meter) 371 and temperature measuring units 361. Note that FIG. 5 is similar to FIG. 1, except that system includes the temperature measuring units 361, and the demand control unit 320 includes a temperature difference unit 321 in addition to a control unit 323, a priority level determining unit 322, an operating rate calculating unit 324 and a high priority level setting unit 325.

In more detail, and as shown in FIG. 5, the temperature difference measuring unit 321 is disposed in an area (A) where the indoor unit 352 is installed and measures the temperature of the area (A). The temperature comparing difference unit 321 then compares the measured temperature of each area (A). The priority level determining unit 322 then sets a priority level of air conditioners of each area according to temperature data obtained through the comparison by the temperature difference comparing unit 321, and the control unit 323 controls an operation of the outdoor units 351 and/or the indoor units 352 according to each priority level set by the priority level determining unit 322.

Further, the air conditioners are divided into groups based on the different measured temperatures. For example, the priority level determining unit 222 divides the multiple air conditioners disposed in each area into multiple groups in which each group includes one or more air conditioners according to the information compared by the temperature comparing unit 321, and then sets a priority level of each group. In addition, as in the other embodiments, the priority level determining unit 322 excludes one or more air conditioners set by the high priority level setting unit 325 from the forcible control operation.

Thus, in setting the priority level, the order of multiple air conditioners is set according to the order of temperature values of each area, and the multiple air conditioners are divided into groups according to the temperature range based on a pre-set temperature. For example, when the air conditioners are used to perform an air cooling operation, the air conditioners are set to have a priority level such that the air conditioner located at a lowest temperature area are given the lowest priority level, and when the air conditioners perform an air heating operation, the air conditioners are set to have a priority level such that the air conditioners located at the highest temperature area are given the lowest priority level.

Thus, when the estimated power amount exceeds the target power amount, one or more air conditioners belonging to the group with a lower priority level are first forcibly controlled, before air conditioners belonging to a group having a higher priority level. In addition, in one example, the air conditioners belonging to the same group are sequentially forcibly controlled. Alternatively, and as discussed in the other embodiments, air conditioners within a same group may also be controlled according to their priority.

Therefore, in this embodiment, when the air conditioners perform the air cooling operation, the air conditioners are forcibly controlled starting from the air conditioners at an area with the lowest temperature, and when the air conditioners perform the air heating operation, the air conditioners are forcibly controlled starting from the air conditioner at an area with the highest temperature.

Thus, when the estimated power amount exceeds the target power amount, one or more air conditioners belonging to the group with a lower priority level is first forcibly controlled, before air conditioners belonging to a group having a higher priority level are controlled. In addition, in one example, the air conditioners belonging to the same group are sequentially forcibly controlled. Alternatively, and as discussed in the other embodiments, air conditioners within a group may also be controlled according to their priority.

Figure 6:
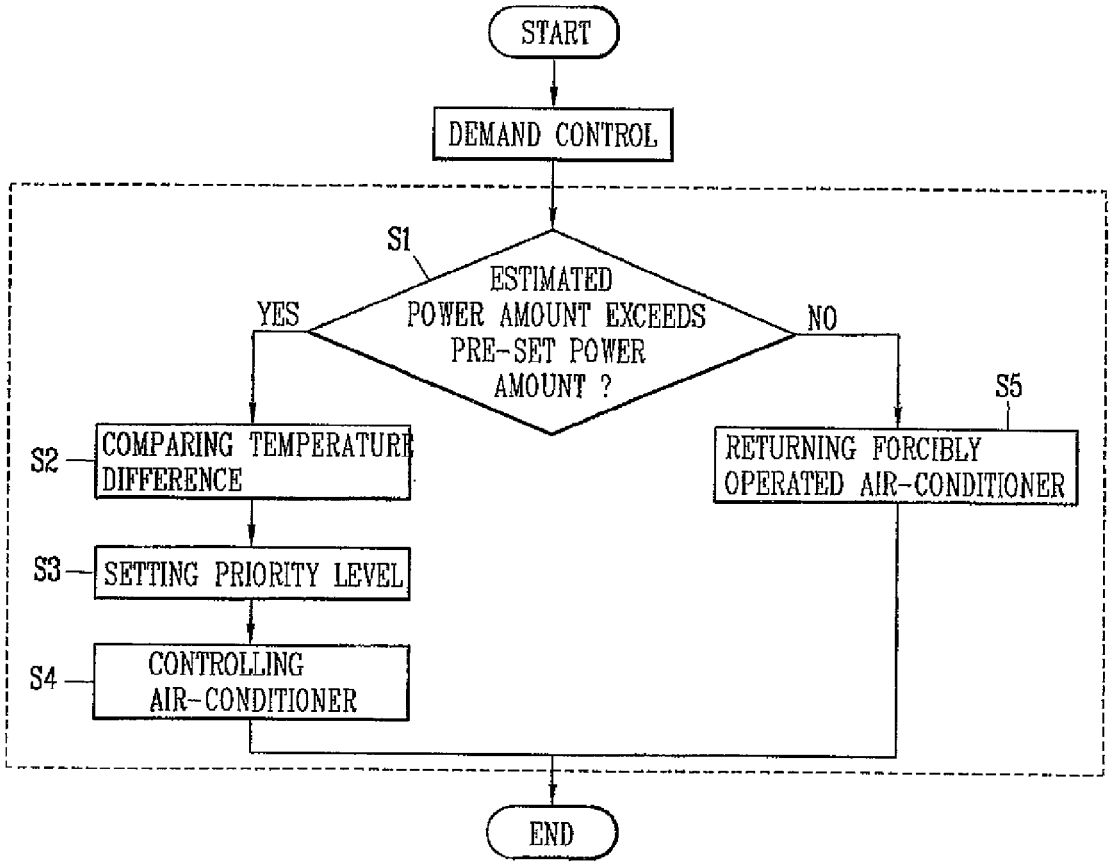
FIG. 6 is a flowchart illustrating a method for controlling multiple air conditioners according to the third embodiment of the present invention.

A method of controlling the multiple air conditioners according to the third embodiment of the present invention will now be described with reference to FIG. 6. FIG. 5 will also be referred to in this description.

First, the power consumption amount detecting unit 310 detects the amount of power measured during a certain time period by the watt-hour meter 371, and transfers the detected power consumption amount to the demand control unit 320. Then, as shown in FIG. 6, the demand control unit 320 estimates an amount of power consumed using the data received from the power consumption amount detecting unit 310 and monitors whether the estimated power amount exceeds a pre-set target power amount (S1).

When the estimated power amount exceeds the target power amount (Yes in S1), the temperature difference comparing unit 321 collects a temperature of each area (A) from the temperature measuring units 361 installed at each area (A) in which the indoor units 352 of the air conditioners are installed, and compares the temperatures of each area (A) (S2). The priority level determining unit 322 then sets the priority level of each air conditioner located in each area (A) according to the compared temperatures (S3).

The control unit 323 then forcibly controls the multiple air conditioners in a sequential manner according to the priority level set by the priority level determining unit 322 and a pre-set operation of air conditioners (S4). That is, the control unit 323 sequentially controls the multiple air conditioners starting from those belonging to a group with the lowest priority level to thus reduce power consumption amount. For example, the control unit 323 controls the multiple air conditioners such that the operation of air conditioners of a corresponding group is changed to an air blowing mode by turning off the indoor units 352 of the corresponding group to stop air-conditioning in the area, or turning off the outdoor units 351 connected with the indoor units 352 of the corresponding group.

However, as in the other embodiments, rather than turning off the indoor units 352 or the outdoor unit 351, the control unit 323 may control the air conditioners to change into a different operation mode that reduces the power consumption. For example, the operation mode may be changed into a dehumidifying mode, the air flow strength (i.e., air blowing amount) may be changed, and the circulation rate of the refrigerant may be adjusted. Further, when the estimated power amount is smaller than the target power amount (No in S1), the demand control unit 320 returns the operation-controlled outdoor units 351 or the indoor units 352 to their original operation state (S5).

As mentioned above, the system and method for controlling multiple air conditioners according to the third embodiment of the present invention advantageously controls the multiple air conditioners based on temperature information of each area of the building to thereby control the power consumption amount while maintaining a uniform level of deviation of temperature of each area of the building. Therefore, the user's comfort level is improved and the multiple air conditioners are controlled in a balanced manner.

As so far described, the system and method for controlling multiple air conditioners according to embodiments of the present invention has several advantages.

That is, when an estimated power amount exceeds a target power amount, priority levels are assigned to the multiple air conditioners and the operation of the air conditioners are controlled according to the given priority levels, so a manger, for example, can select a certain air conditioner to be forcibly controlled to thereby improve a user's comfort level.

In addition, because an operation history of the forcibly controlled air conditioners is recorded and the priority levels of the air conditioners are set according to each recorded control history, a particular air conditioner is prevented from being lopsidedly controlled.

Moreover, because the priority levels of the air conditioners located in respective areas are set according to temperature information of each area of the building and the operation of the air conditioners are controlled according to the order of the priority levels, the user's comfort level is drastically improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A system for controlling multiple air conditioners, the system comprising:

a demand control unit configured to divide the multiple air conditioners into groups, to assign a priority level to each group, to calculate an estimated power amount used by the multiple air conditioners based on an amount of power consumed by the multiple air conditioners during a predetermined time period, and to forcibly control an operation of one or more air conditioners included in a respective group based on the priority level assigned to the respective group, wherein the demand control unit comprises:

an operation rate calculating unit configured to compare the estimated power amount and a pre-set target power amount, and to calculate an operation rate of the multiple air conditioners based on a result of the comparison;

a high priority level setting unit configured to set the at least one air conditioner to have the highest priority level so as to exclude the at least one air conditioner having the highest priority level from being forcibly controlled;

a priority level determining unit configured to divide the multiple air conditioners into the groups, and to assign the priority level to each group; and a control unit configured to forcibly control the operation of the one or more multiple air conditioners included in the respective group based on the priority level assigned to the respective group and the set highest priority level, and wherein the groups are automatically determined by the control unit based upon previous operation characteristics of the air conditioners, temperature differences in the rooms of the building, and pre-assigned values given to the air conditioners.

2. The system of claim 1, wherein the priority level determining unit assigns the priority level to each group in a sequential manner such that a first group is assigned a first priority level and a second group is assigned a second priority level that is higher than the first priority level.

3. The system of claim 1, wherein the priority level determining unit assigns the priority level to each group based on an importance degree of air conditioners in each group.

4. The system of claim 1, wherein the priority level determining unit further assigns a priority level to each of the one or more air conditioners in the respective group, and the control unit forcibly controls the operation of the one or more air conditioners in the respective group based on the priority level assigned to the respective group and the priority level assigned to each of the one or more air conditioners in the respective group.

5. The system of claim 1, wherein the demand control unit further comprises:

a history recording unit configured to record a forcible control history of the multiple air conditioners.

6. The system of claim 5, wherein the control unit forcibly controls the operation of the one or more air conditioners included in the respective group based on the priority levels assigned to the respective group and the recorded forcible control history of the one or more air conditioners.

7. The system of claim 6, wherein the control unit does not forcibly control an air conditioner that has been previously forcibly controlled within a predetermined amount of time or that has been previously forcibly controlled more than a pre-set number of times within the predetermined amount of time.

8. The system of claim 1, further comprising:

a temperature measuring unit configured to detect indoor temperatures of at least first and second areas cooled by first and second groups of air conditioners, respectively, and to compare the detected indoor temperatures.

9. The system of claim 8, wherein the priority level determining unit assigns the priority level of the first and second groups based on the compared detected indoor temperatures.

10. The system of claim 9, wherein the priority level determining unit assigns the priority level of the first group to have a first priority and the second group to have a second priority when the detected temperature of the first group of air conditioners is cooler than the detected temperature of the second group of air conditioners, and wherein the control unit forcibly controls the first group of air conditioners before the second group of air conditioners.

11. The system of claim 1, wherein the control unit forcibly controls the multiple air conditioners by turning off an indoor unit or an outdoor unit of the multiple air conditioners or by changing an operation mode of the multiple air conditioners.

12. A method for controlling multiple air conditioners, the method comprising:

dividing the multiple air conditioners into groups;

assigning a priority level to each group;

calculating an estimated power amount used by the multiple air conditioners based on an amount of power consumed by the multiple air conditioners during a predetermined time period;

comparing the estimated power amount and a pre-set target power amount;

calculating an operation rate of the multiple air conditioners based on a result of the comparison; and setting the at least one air conditioner to have the highest priority level so as to exclude the at least one air conditioner having the highest priority level from being forcibly controlled, forcibly controlling an operation of one or more air conditioners included in a respective group based on the priority level assigned to the respective group; and automatically determining the groups based upon previous operation characteristics of the air conditioners, temperature differences in the rooms of the building, and pre-assigned values given to the air conditioners.

13. The method of claim 12, wherein the assigning step assigns the priority level to each group in a sequential manner such that a first group is assigned a first priority level and a second group is assigned a second priority level that is higher than the first priority level.

14. The method of claim 12, wherein the assigning step assigns the priority level to each group based on an importance degree of air conditioners in each group.

15. The method of claim 12, wherein the assigning step further comprises:

assigning a priority level to each of the one or more air conditioners in the respective group, and wherein the forcibly controlling step forcibly controls the operation of the one or more air conditioners in the respective group based on the priority level assigned to the respective group and the priority level assigned to each of the one or more air conditioners in the respective group.

16. The method of claim 12, further comprising:

recording a forcible control history of the multiple air conditioners.

17. The method of claim 16, wherein the forcibly controlling step forcibly controls the operation of the one or more air conditioners included in the respective group based on the priority levels assigned to the respective group and the recorded forcible control history of the one or more air conditioners.

18. The method of claim 17, wherein the forcibly controlling step does not forcibly control an air conditioner that has been previously forcibly controlled within a predetermined amount of time or that has been previously forcibly controlled more than a preset number of times within the predetermined amount of time.

19. The method of claim 12, further comprising:

detecting indoor temperatures of at least first and second areas cooled by first and second groups of air conditioners, respectively; and comparing the detected indoor temperatures.

20. The method of claim 19, wherein the assigning step assigns the priority level of the first and second groups based on the compared detected indoor temperatures.

21. The method of claim 20, wherein the assigning step assigns the priority level of the first group to have a first priority and the second group to have a second priority when the detected temperature of the first group of air conditioners is cooler than the detected temperature of the second group of air conditioners, and wherein the forcibly controlling step forcibly controls the first group of air conditioners before the second group of air conditioners.

22. The method of claim 12, wherein the forcibly controlling step forcibly controls the multiple air conditioners by turning off an indoor unit or an outdoor unit of the multiple air conditioners or by changing an operation mode of the multiple air conditioners.

* * * * *